US008752216B2

(12) United States Patent
Sawle et al.

(10) Patent No.: US 8,752,216 B2
(45) Date of Patent: Jun. 17, 2014

(54) COMPRESSION GARMENT

(75) Inventors: Leanne Sawle, Redruth (GB); Elaine Winstanley, Redruth (GB); Martin Matthews, Redruth (GB)

(73) Assignee: DM Orthotics Limited (GB)

( * ) Notice: Subject to any disclaimer, the term of this patent is extended or adjusted under 35 U.S.C. 154(b) by 361 days.

(21) Appl. No.: 12/850,148

(22) Filed: Aug. 4, 2010

(65) Prior Publication Data

US 2012/0029407 A1 Feb. 2, 2012

(30) Foreign Application Priority Data

Aug. 2, 2010 (GB) ..... 1013024.3

(51) Int. Cl.
*A41D 1/06* (2006.01)

(52) U.S. Cl.
USPC ..... 2/228

(58) Field of Classification Search
USPC ..... 2/400, 401, 403, 404, 408–410, 412, 2/228; 450/94, 95; 602/61, 75
See application file for complete search history.

(56) References Cited

U.S. PATENT DOCUMENTS

| | | | |
|---|---|---|---|
| 3,261,359 A | 7/1966 | Gould | |
| 3,307,312 A | 3/1967 | Kreibaum | |
| 3,393,675 A | 7/1968 | Trznadel et al. | |
| 3,396,730 A | 8/1968 | Fox | |
| 4,862,523 A | 9/1989 | Lipov | |
| 5,131,100 A | 7/1992 | Atwater et al. | |
| 5,205,815 A | 4/1993 | Saunders | |
| 5,403,271 A | 4/1995 | Saudners et al. | |
| 5,782,790 A | 7/1998 | Allen | |
| 5,957,873 A | 9/1999 | Allen | |
| 6,006,363 A | 12/1999 | Karlin | |
| 6,023,789 A | 2/2000 | Wilson et al. | |
| 6,041,441 A | 3/2000 | Counts et al. | |
| 6,086,551 A | 7/2000 | Allen | |
| 6,146,240 A | 11/2000 | Morris | |
| 6,161,222 A | 12/2000 | Strickland et al. | |
| 6,430,752 B1 | 8/2002 | Bay | |
| 6,571,115 B2 | 5/2003 | Axelgaard et al. | |
| 6,728,973 B1 * | 5/2004 | Webley et al. | 2/400 |
| 6,850,791 B1 | 2/2005 | Axelgaard et al. | |

(Continued)

FOREIGN PATENT DOCUMENTS

| | | |
|---|---|---|
| CA | 2473750 | 5/2003 |
| EP | 1441609 | 2/2007 |
| EP | 1347800 | 9/2009 |
| FR | 1153483 | 3/1958 |

OTHER PUBLICATIONS

DM Active Sport; DM Active DIFCAS* Shorts; 2 pages; Aug. 2010.

(Continued)

*Primary Examiner* — Katherine Moran
(74) *Attorney, Agent, or Firm* — Gardner Groff Greenwald & Villanueva, P.C.

(57) ABSTRACT

A compression garment, for example a pair of compression shorts (10, 210, 310), has a trunk section (20), a left leg section (30) and a right leg section (40) constructed from a resilient material. The trunk section (20) is reinforced such that a wearer's pelvic region is subjected to a first compressive force acting diagonally across a front portion of the trunk section from left to right and a second compressive force acting diagonally from right to left. The range of motion at the wearer's hips is preferably not restricted by the reinforcement.

24 Claims, 5 Drawing Sheets

(56) References Cited

U.S. PATENT DOCUMENTS

| | | | | |
|---|---|---|---|---|
| 7,074,204 | B2 * | 7/2006 | Fujii et al. | 602/75 |
| 7,931,639 | B2 * | 4/2011 | Suga et al. | 604/396 |
| 2009/0077720 | A1 * | 3/2009 | Shinomiya | 2/401 |
| 2009/0133182 | A1 * | 5/2009 | Inagaki et al. | 2/404 |

OTHER PUBLICATIONS

Sports Science and Sports Medicine Conference Presentation Developing a Dynamic Elastomeric Fabric Orthoses (DEFO) Aimed at Aiding Return to Sport After Lumbopelvic Injury; 22 pages; University of Plymouth; Aug. 2010.

ISPO Congress Presentation Developing a Dynamic Elastomeric Fabric Orthoses (DEFO) Aimed at Aiding Return to Sport After Lumbopelvic Injury; 25 pages; University of Plymouth; Aug. 2010.

Prosthetics and Orthotics International "Effects of dynamic elastomeric fabric orthoses on children with cerebral palsy"; 9 pages; Martin John Matthews, et al; Dec. 2009.

Community Trademark Registration No. 001149777-0001/2/3; 6 pages.

* cited by examiner

COMPRESSION GARMENT

CROSS-REFERENCE TO RELATED APPLICATION

This application claims the priority benefit of United Kingdom Patent Application Serial No. 1013024.3, filed Aug. 2, 2010, which is hereby incorporated herein by reference.

The invention relates to a compression garment and in particular to a pair of athletic compression shorts for prevention of or treatment of pelvic disorders and injuries.

BACKGROUND

The Lumbopelvic region encompasses the sacroiliac joints, the symphysis pubis, and the groin (adductor) muscles. There are many structures such as ligaments and muscles contributing to stability in this region, and dysfunction in any structure can result in pain and/or instability.

Pelvic disorders and injuries, such as athletic lumbopelvic dysfunction (LPD), are a common problem among male and female athletes participating in sporting activities. Lumbopelvic pain often results from overexertion and/or overuse of the pelvis, and can lead to conditions including adductor tears, sacroiliac joint dysfunction and osteitis pubis. Such injuries are often refractory to treatment and can limit an athlete's return to competitive sport.

Due to many pelvic structures being linked anatomically, there is often a difficulty in diagnosing the primary site of pain or dysfunction. Often there is more than one structure involved; for example, there may be a hip, groin, lumbar spine and/or abdominal component involved in the disorder. Pelvic disorders are, therefore, often difficult to diagnose accurately as there is often more than one site of injury. Secondary sources of pain are often missed and often not accounted for in treatments prescribed for primary sources of pain. Groin pain may occur in between 2-5% of all sports injuries, and the incidence of groin pain may be far higher in some sports, for example groin pain may occur with between 10-18% of all football injuries.

A wide range of techniques are currently used to treat pelvic injuries, for example electrotherapy, surgery, strengthening and stabilisation of the pelvic joints and hydrotherapy. Research using pelvic belts has indicated that compressive forces applied transversely to the pelvis can result in an improved lumbopelvic stability and reduced lumbopelvic pain. Dynamic elastomeric fabric orthoses (DEFOs) such as compression shorts have also been used for preventing and treating athletic lumbopelvic injuries.

U.S. Pat. No. 6,430,752 discloses a pair of compression shorts for restricting movement in certain areas of a wearer's body to protect injured or recovering muscles. However, the compression shorts of U.S. Pat. No. 6,430,752 have been reported to restrict an athlete's range of motion during hip flexion. Such a restricted range of motion is likely to affect the performance of athletes participating in their sport while wearing the shorts. Any loss of performance caused by the restricted range of motion will be more keenly felt in technical sports such as high jump, triple jump, or hurdles.

SUMMARY OF INVENTION

The invention provides compression garments and methods as defined in the appended independent claims, to which reference should now be made. Preferred or advantageous features of the invention are defined in various dependent sub-claims.

The inventors of the compression garments according to various aspects of the invention set out to develop a DEFO that could be used to aid in the management of a wide range of lumbopelvic disorders, and may also be worn on a day-to-day basis by athletes whilst actively participating in their sport to help prevent occurrence of pelvic and groin injuries.

To help inform the design of the garment a study was performed to determine the impact of the direction of an applied force on athletic lumbopelvic pain. A sample of athletically active male and female subjects with pelvic pain were selected, between them the subjects participating in a wide range of sports including rugby, running, football, sailing, power walking, badminton and squash.

Compressive belts were used to apply a number of different compression conditions to the pelvic region of each subject. The conditions applied were, transverse compression, diagonal compression towards a site of pain, diagonal compression away from a site of pain, and bilateral diagonal compression. For each compression condition the subjects underwent various tests and the levels of pain were assessed. As a control, the subjects underwent the same tests with no compression applied to the pelvic region.

The results of the test showed that different compressions relived pain encountered under different testing conditions. Diagonal compressive forces were most effective at relieving pain during function. The inventors set out to design a compression garment that could be worn to manage lumbopelvic pain and function pain in a wide range of subjects and still be worn while performing athletic activity.

Thus, in a first aspect the invention may provide a compression garment, for example a pair of compression shorts, fabricated from a resilient material. The compression garment comprises a trunk section for conforming to a wearer's pelvic region, a left leg section and a right leg section. The trunk section has a front portion and a rear portion that meet at left and right side-seams of the garment to encircle a wearer's hips. The front portion and rear portion of the trunk section may also meet at a crotch-seam in embodiments of the garment where an anatomical fit to the crotch region is desirable. Each leg section is joined to the trunk section at a seam that encircles an upper portion of the wearer's left and right leg respectively. This seam follows the line of a wearer's groin and may be termed a groin-seam or a leg-shoulder-seam.

It is preferred that the trunk section and the leg sections are made from a resilient elastomeric fabric that conforms to the wearer's body shape but does not exert any strong forces that may restrict movement of the wearer's legs. Thus, it is preferred that the material is highly elastic such that it allows free movement of the hips and legs. Suitable materials are well known in the manufacture of close fitting garments, for example various Lycra/Spandex materials.

The trunk section is reinforced such that, when the shorts are worn, the wearer's pelvic region is compressed by a first force acting in a direction extending substantially diagonally-downwards across the front portion between the left side-seam and the right leg-shoulder-seam, and a second force acting in a direction extending substantially diagonally-downwards across the front portion between the right side-seam and the left leg-shoulder-seam.

Thus, the reinforcement to the trunk section provides a bilateral diagonal compression to the wearer's pelvic region. Such a compression may provide a compressive force to the symphysis pubis joint and increase the force closure of the pelvis. The diagonal bilateral compression may also influence the wearer's anterior diagonal muscle slings. This combination may increase the core stability of a subject wearing the garment, thereby reducing the subject's risk of injury while participating in sports, or may assist the subject's recovery from an existing injury.

A further effect of the reinforcement of the trunk section is that proprioception of the anterior pelvic region and the symphysis pubis joint may be significantly increased. Proprioception is a term relating to an individual's subconscious awareness of a bodily region such as a joint or a limb. By increasing proprioception of the anterior pelvic region and the symphysis pubis in particular, a wearer may be less likely to overexert that region during sporting activity.

The reinforcement of the trunk section only has a compressive effect on the pelvic region of the wearer. As the reinforcing forces only extend between a side-seam of the garment and a leg-shoulder-seam, the legs of the wearer are not restricted by the reinforcing force. Although compression may be provided in a number of directions to the pelvis, and the symphysis pubis joint may be compressed, the wearer's range of motion at the hips is not substantially affected and the wearer's legs are free to move with the same range of motion they would have in an un-reinforced compression garment. This may provide the advantage that a sportsperson or athlete can wear the garment while engaged in sporting activity, without encountering a restricted range of mobility due to reinforcement forces generated by the garment. Therefore the compression garment may, if worn during sporting activity, have a prophylactic or preventative effect against pelvic injuries and/or disorders.

Preferably, the first force is generated by a front reinforcement panel, or a plurality of front reinforcement panels, extending diagonally across the front portion of the trunk section and attached to the garment at the left side-seam and the right leg-shoulder-seam, and the second force is generated by a front reinforcement panel, or plurality of front reinforcement panels, extending diagonally across the front portion of the trunk section and attached to the garment at the right side-seam and the left leg-shoulder-seam.

It is preferred that reinforcement panels are formed from a material that provides less elastic deformation, or greater stiffness, than the material used to construct the trunk and leg sections. This may increase the ability of the reinforcement to exert force in predetermined directions. Elastomeric fabrics such as Lycra are still suitable, but it is preferred that the panels are formed from a material having sufficient thickness, or from a sufficiently stiff material, to provide the required reinforcement forces. The reinforcement panels may also be made from a material that has anisotropic properties, i.e. a material that allows a lower elastic deformation in one direction than in another.

In certain garments embodying the invention the first and second forces may be generated by separate first and second front reinforcement panels. Thus, the garment may have a first front reinforcement panel extending from the left side-seam to the right leg-shoulder-seam and a second front reinforcement panel extending from the right side-seam to the left leg-shoulder-seam. Preferably the first and second front reinforcement panels cross each other at a point covering the wearer's symphysis pubis joint, and increase compression of the symphysis pubis joint and increase proprioceptive awareness in this region.

It is preferred that the first and second forces act in directions extending diagonally-downwards across the front portion of the trunk section at an angle of between 20 degrees and 35 degrees from a horizontal direction across the front of the garment. This is a relatively shallow angle and may advantageously provide a force component that acts transversely across the front of a wearer's pelvis, increasing force closure and core stability.

The first and second front reinforcement panels are preferably strips of material that have a length dimension extending substantially diagonally between a side-seam and a leg-shoulder-seam, and a width dimension substantially perpendicular to the length dimension. Preferably the width dimension is between 5 cm and 15 cm, particularly preferably between 6 cm and 10 cm. Each panel could be a single strip of material or may be formed from a plurality of narrow strips of material arranged in alignment across the front portion of the trunk section to provide the required force components.

In a preferred garment embodying the invention the first and second forces are generated by a single front reinforcement panel. Such a reinforcement panel may be arranged such that an upper left portion of the front reinforcement panel is attached to the garment at the left side-seam, an upper right portion of the front reinforcement panel is attached to the garment at the right side-seam, a lower left portion of the front reinforcement panel is attached to the garment at the left leg-shoulder-seam, and a lower right portion of the front reinforcement panel is attached to the garment at the right leg-shoulder-seam. Thus, the selection of the points of attachment of a single front reinforcement panel to the garment allows bilateral diagonal compression forces to be generated in the wearer's pelvis in the same way as if two, separate, diagonally-crossing panels had been attached.

The single front reinforcement panel may be substantially x-shaped; mimicking the shape formed by two, separate, panels attached to the garment in a cross-over formation. The front panel may have other shapes, however. For example, it may be advantageously possible to generate transverse and longitudinal forces acting on the wearer's pelvic region if the front reinforcement panel is substantially bow-tie shaped, i.e. the panel may be wider at its edges where it attaches to the side-seams than in its middle. Such a shape may allow the panel to be attached to a greater length of the left and right side seams and may improve the effectiveness of the reinforcement.

It is preferred that the trunk section is reinforced such that, when the garment is worn, the wearer's pelvic region is compressed by a third force extending substantially horizontally, or transversely, across the rear portion between the left side-seam and the right side-seam. The third force may be advantageously generated by a rear reinforcement panel, or panels, attached to the garment at the left side-seam and at the right side-seam. Preferably the rear reinforcement panel covers the wearer's left and right sacroiliac joints. A rear reinforcement panel preferably joins with the front reinforcement panels at the hip, resulting in a garment comprising reinforcement panels encircling the entire pelvis.

The width of the rear reinforcement panel, or panels, is preferably between 5 cm and 15 cm, where it joins to the left and right side-seams, and preferably between 6 cm and 10 cm. It may be preferable that the rear reinforcement panel has a greater width at a central point between the left and right seams than at the left and right seams. This may help to increase the proprioceptive effect of the rear reinforcement panel on the region around the wearer's sacroiliac joints.

The trunk section has an upper edge defining an opening for encircling the wearer's torso at or above the wearer's waist. Advantageously, one or more darts may be formed in the upper edge to improve engagement of the garment with the wearer's torso. It may be beneficial that the upper edge securely engages with a wearer's torso as this may help maintain the reinforcement panels in an optimum position to improve stability, force closure and proprioception at the pelvic region.

In a preferred embodiment of the invention the compression garment is a pair of compression shorts. Thus, the left leg section may define a left leg opening for encircling the wearer's left leg above the wearer's left knee, and the right leg section may define a right leg opening for encircling the wearer's right leg above the wearer's right knee. It is advantageous for the leg openings to securely grip the leg of the wearer as this may also assist the correct positioning of the reinforcement panels on the trunk section. Preferably the left and right openings are between 1 cm and 25 cm above the wearer's knees.

It is preferred that the compression garment provides a compressive force to the wearer's left and right sacroiliac joints, and to the wearer's symphysis pubis joint.

The garment may have compression panels or reinforcement attached to the leg sections. Such panels or reinforcement should not affect the wearer's range of motion of the leg, however. It is preferred that any reinforcement to the garment provides no substantial limitation to the wearer's active range of motion during hip flexion. It is also preferred that there is no reinforcement of the leg sections of the garment.

It may be advantageous to the force closure of the various pelvic joints that, when the garment is worn, a compression force generated at the hips, as measured at the left or right side-seam, is between 15 and 28 mm Hg (approximately between 2000 and 3730 Pa (1 Pa=1 N/m2)), preferably between 20 and 25 mm Hg (approximately between 2666 and 3333 Pa), particularly preferably about 23 mm Hg (approximately 3066 Pa).

In a second aspect the invention may provide a compression garment fabricated from a resilient material and comprising, a trunk section for conforming to a wearer's pelvic region, a left leg section for conforming to at least an upper portion of the wearer's left leg, and a right leg section for conforming to at least an upper portion of the wearer's right leg. The trunk section is reinforced by panels of resilient material such that compressive forces are provided, when the garment is worn, to the wearer's sacroiliac joints and symphysis pubis, and in which no reinforcement panels extend to either leg section. Thus, the leg movement of the wearer is not hindered by the reinforcement panels applied to the trunk section.

Preferably, a rear portion of the trunk section is reinforced by a panel or panels of a resilient material extending horizontally across a rear portion of the trunk section. Preferably, a front portion of the trunk section is reinforced by a panel or panels of a resilient material extending diagonally across the front portion from left to right and from right to left. It may be particularly preferable that the panel or panels on the front portion of the trunk section extend between an upper left side portion of the garment to a lower right groin portion of the garment and from an upper right side of the garment to a lower left groin portion of the garment. As long as the panels do not extend beyond a wearer's groin they are unlikely to adversely affect the range of movement of the wearer's legs.

The reinforcement panel or panels of a garment according to this second aspect of the invention mat be provided in any configuration as described above in relation to the first aspect of the invention.

The invention may also provide for the use of a compression garment according to any aspect described above when used for the treatment of lumbopelvic injuries or disorders, or when used as a prophylactic to help prevent lumbopelvic injuries or disorders. For example, a garment according to an aspect of the invention may be used by an athlete engaged in sporting activity such as training for, or competing in, and event.

SPECIFIC EMBODIMENTS OF THE INVENTION

Specific embodiments of the invention will now be described with reference to the figures, in which.

Figure 1:
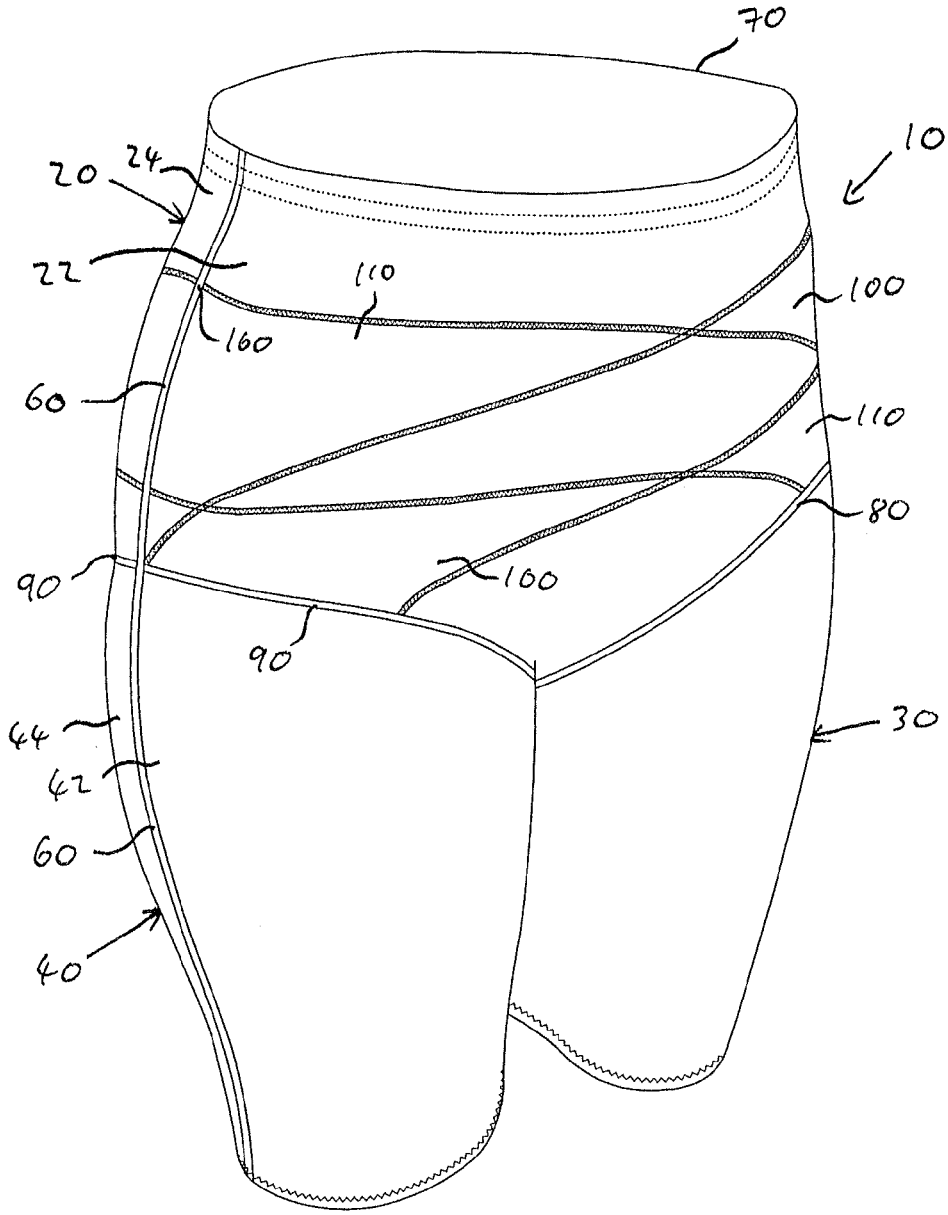
FIG. 1 illustrates a perspective view of a pair of compression shorts according to a first embodiment of the invention.
Figure 2:
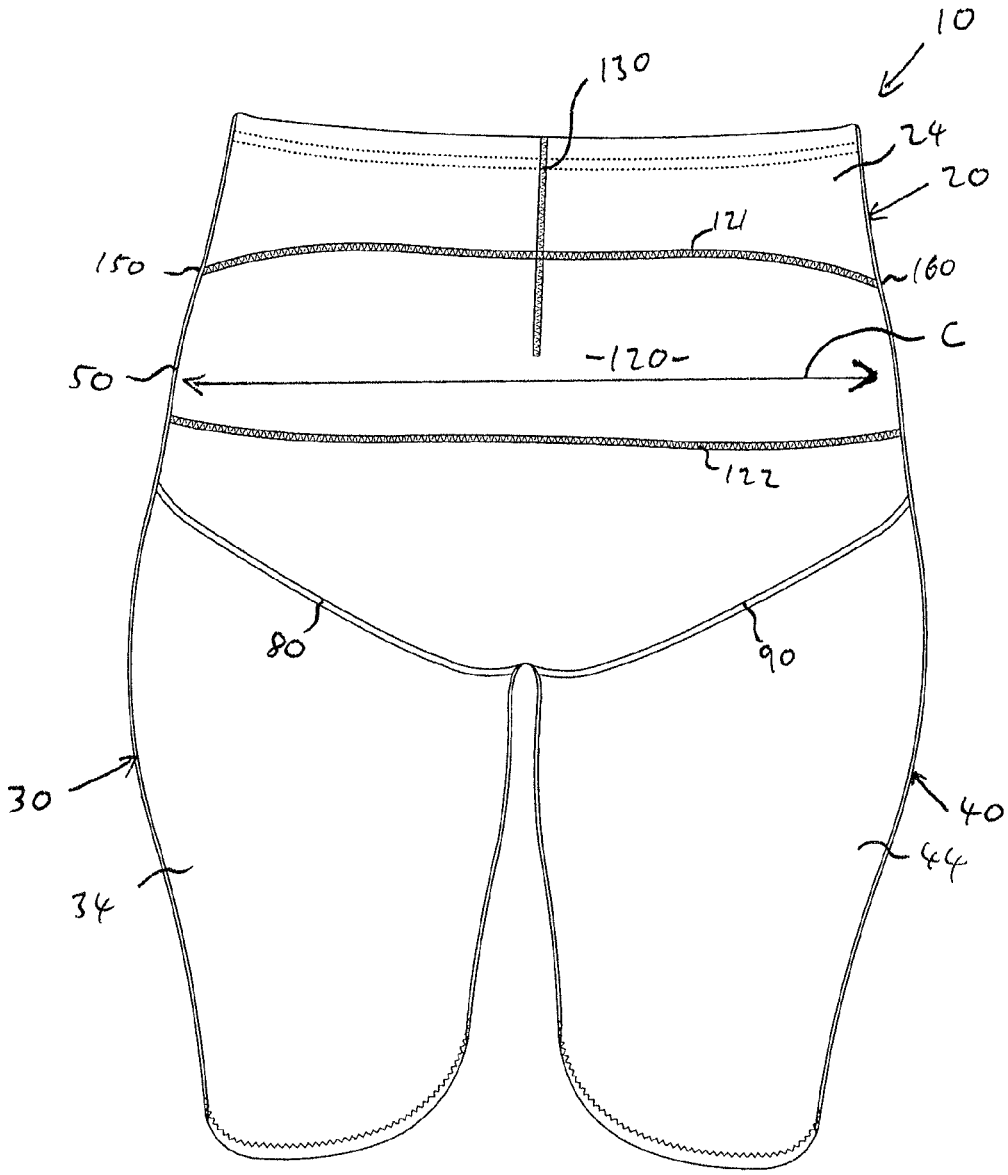
FIG. 2 illustrates a rear view of the compression shorts of FIG. 1.
Figure 3:
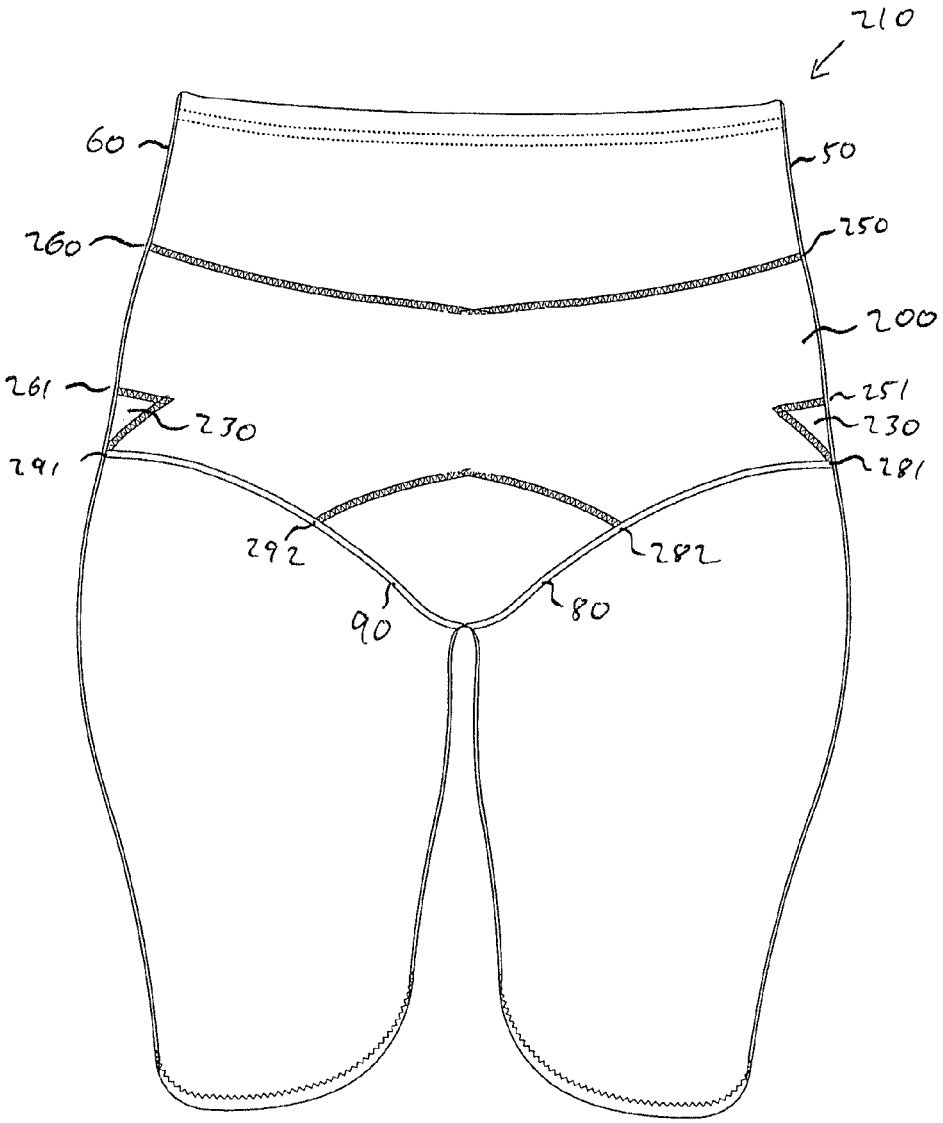
FIG. 3 illustrates a front view of the compression shorts of FIG. 1.

FIGS. 1, 2, and 3 illustrate a pair of compression shorts according to a specific embodiment of the invention. The shorts 10 comprise a trunk section 20 for conforming to a wearer's pelvic region, a left leg section 30 and a right leg section 40.

The trunk section 20 comprises a front, or anterior, portion 22 and a rear, or posterior, portion 24. The front portion 22 and the rear portion 24 are joined together at a left side-seam 50 and a right side-seam 60 and at a crotch-seam (not visible in the figures). The trunk section has an upper edge 70 defining an opening for encircling a wearer's torso at or above the wearer's waistline. An upper hem 72 is associated with the upper edge 70.

The left leg section 30 comprises a front portion 32 and a rear portion 34 joined at the left side seam 50 and at a left inner-leg seam 38. The right leg section 40 comprises a front portion 42 and a rear portion 44 joined at the right side seam 60 and at a left inner-leg seam 48. Both leg portions terminate at a lower edge 39, 49 defining openings for encircling the wearer's left and right legs.

The left leg section 30 is attached to the trunk section 20 at a left leg-shoulder-seam 80 that encircles an upper portion of the leg section. The left leg-shoulder-seam encircles a wearer's leg at the uppermost portion of the leg and follows the groin line of the wearer to provide an anatomical fit to the body. Thus, as the wearer raises his left knee, a front portion of the left leg-shoulder-seam will be positioned in the fold formed by the wearer's groin. The right leg section 40 is attached to the trunk section 20 at a right leg-shoulder-seam 90 that corresponds to the left leg-shoulder-seam.

The trunk section 20 and both leg sections 30, 40 are manufactured from an elastomeric material composed of 51% Polyamide, 32% Dorlastan and 17% Cotton. This base material is elastic, such that the garment conforms to the wearer's body shape, and highly stretchable, to allow free movement. This material composition is exemplary only, and many other compositions are available to the skilled person that would perform the same functions.

The front portion of the trunk section 22 is reinforced with a first reinforcement panel 100. Ends of this reinforcement panel are attached to the garment 10 at the left side-seam 50 and at the right leg-shoulder-seam 90. Edges of this panel are stitched to the front portion 22 (stitch lines 101 and 102) such that the panel extends diagonally across the front portion. When worn, the reinforcement panels generates a compressive force on the wearer's pelvis that acts in a diagonal direction across the front portion 22 as indicated on FIG. 2 by the arrow denoted A.

The front portion of the trunk section 22 is reinforced with a second reinforcement panel 110. Ends of this reinforcement panel are attached to the garment 10 at the right side-seam 60 and at the left leg-shoulder-seam 80. Edges of this panel are stitched to the front portion 22 (stitch lines 111 and 112) such that the panel extends diagonally across the front portion. When worn, the reinforcement panels generates a compressive force on the wearer's pelvis that acts in a diagonal direction across the front portion 22 as indicated on FIG. 2 by the arrow denoted B.

The rear portion of the trunk section 24 is reinforced with a third reinforcement panel 120. Ends of this reinforcement panel are attached to the garment 10 at the right side-seam 60 and at the left side-seam 50. Edges of this panel are stitched to the front portion 22 (stitch lines 121 and 122) such that the panel extends horizontally across the rear portion. When worn, the reinforcement panels generates a compressive force that acts in a transverse direction across the rear portion 22 as indicated on FIG. 2 by the arrow denoted C.

A dart 130 is formed in the upper edge 70 of the trunk section to allow the garment to conform more closely to a wearer's torso. The dart is closed by a line of stitching.

The upper edge 101 of the first reinforcement panel 100 intersects with the left side-seam 50 at the same point 150 as the upper edge 121 of the third reinforcement panel 120. Likewise, the upper edge 111 of the second reinforcement panel 110 intersects with the right side-seam 60 at the same point 160 as the upper edge 121 of the third reinforcement panel 120.

The width of the third reinforcement panel 120 may increase such that the panel covers a wearer's sacroiliac joints.

The reinforcement panels are formed from a material having a composition of 81% Polyamide and 19% Lycra (Spandex). This material stretches less that the base material used for the trunk and leg sections, and allows powerful forces to be developed. The compressive force generated at the hip by shorts according to the invention has been measured as 23 mm Hg.

The reinforcement of the front panel need not be achieved by a single panel crossing the front portion of the trunk section diagonally from left to right and a single panel crossing diagonally from right to left. It could be envisaged that a plurality of narrower panels may be deployed to achieve the same effect.

Alternatively, the reinforcement of the front panel may be achieved by a single reinforcement panel.

Figure 4:
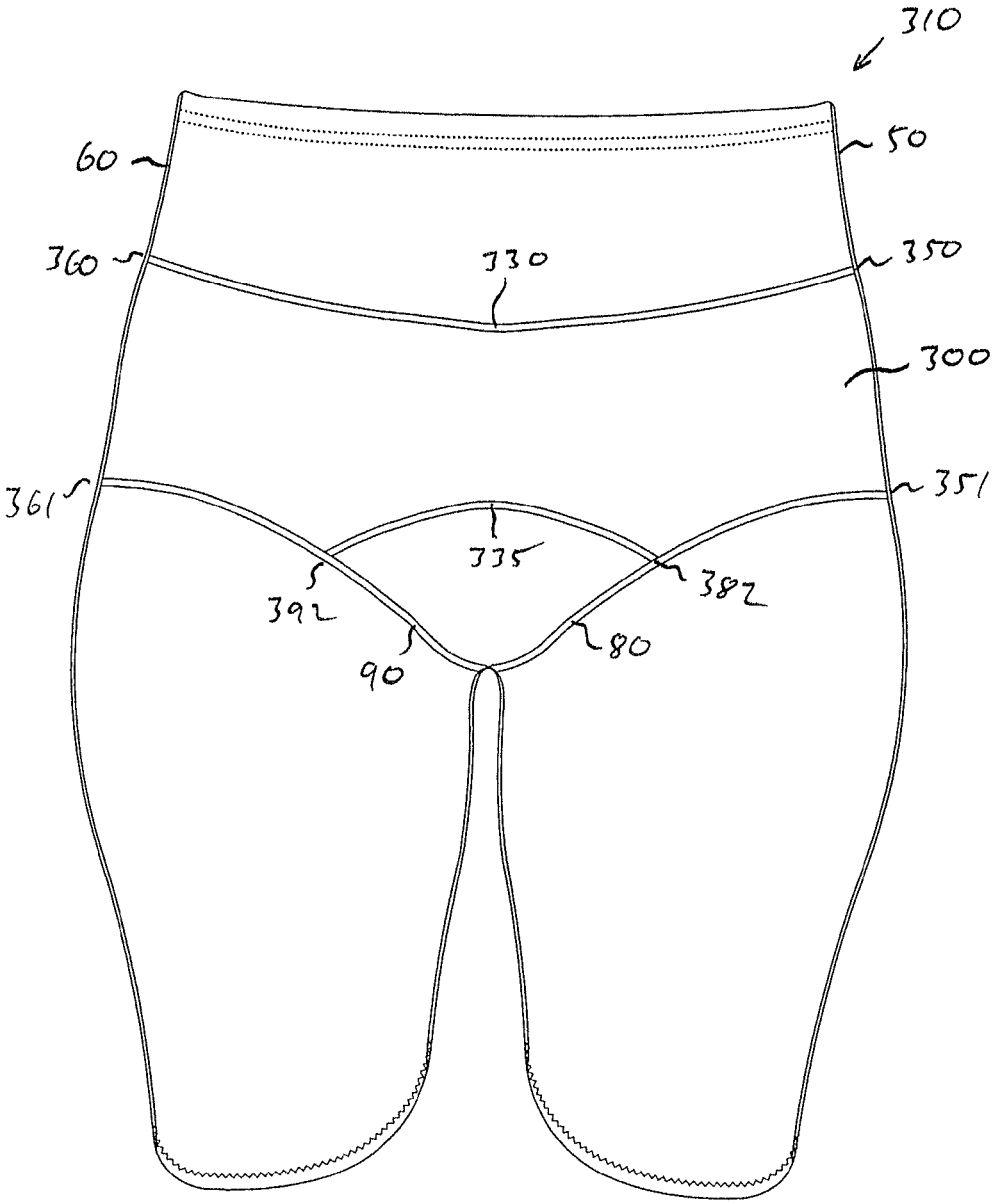
FIG. 4 illustrates a front view of a pair of compression shorts according to a second embodiment of the invention.

FIG. 4 illustrates a front view of a second embodiment of a pair of compression shorts 210 according to the invention. The shorts are the same as the shorts described in the first embodiment above with the difference that there is only a single front reinforcement panel 200. The panel is substantially x-shaped and is joined to the left side-seam 50 between an upper point 250 and a lower point 251, and attached to the right side-seam 60 between an upper point 260 and a lower point 261. The panel 200 is attached to the left leg-shoulder-seam 80 between a first point 281 and a second point 282, and to the right leg-shoulder-seam 90 between a first point 291 and a second point 292. Indents 230 are provided on the left and right and the outline of the panel 200 is stitched to attach it to the trunk section of the shorts.

Figure 5:
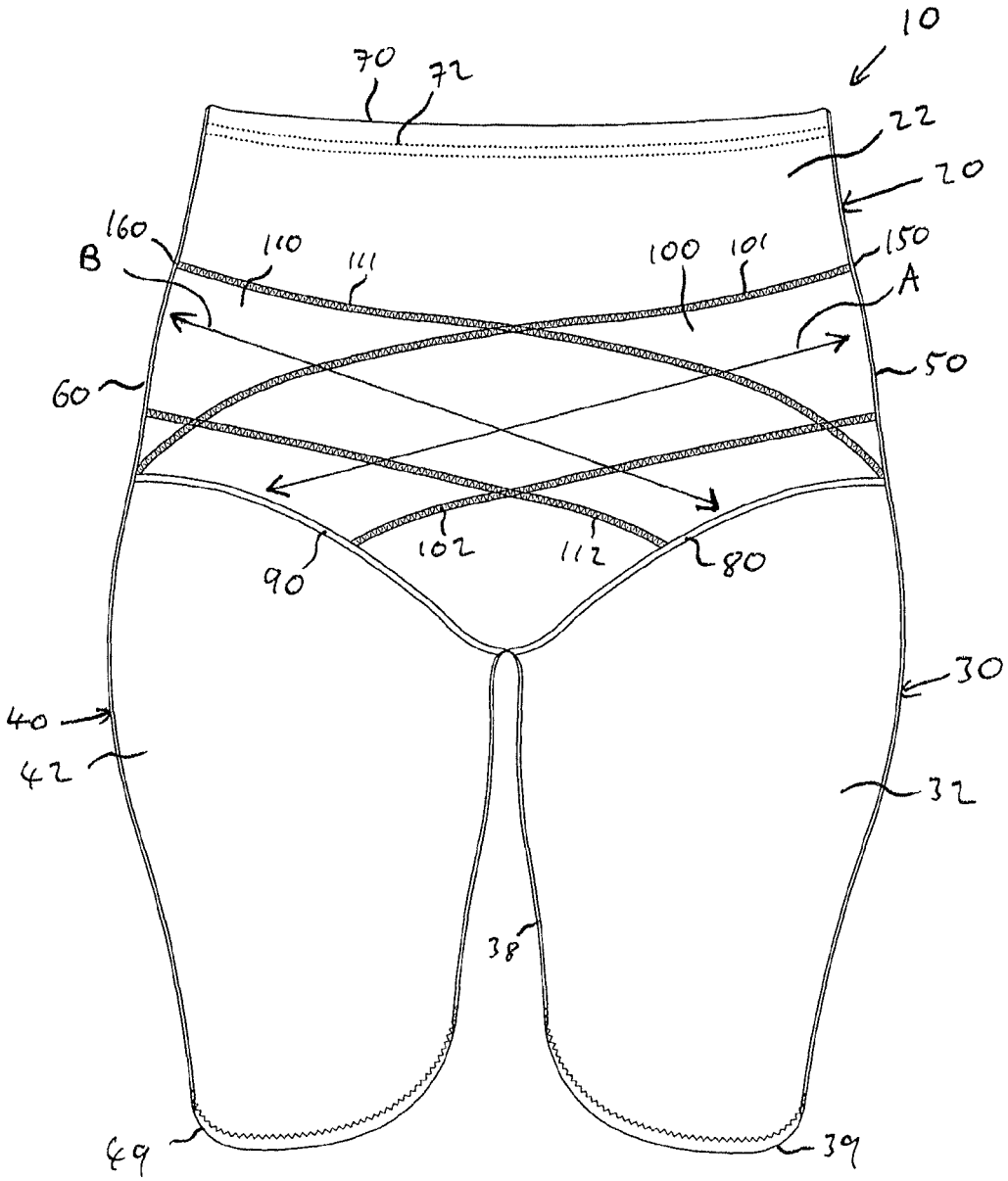
FIG. 5 illustrates a front view of a pair of compression shorts according to a third embodiment of the invention.

FIG. 5 illustrates a third embodiment of a pair of compression shorts 310 according to the invention. The features of the shorts are the same as described above with respect to FIGS. 1 to 3 with the exception that the front reinforcement is achieved by means of a single reinforcement panel 300 providing the first and second forces extending diagonally-downwards between the side-seams 50, 60 and the leg-shoulder-seams 80, 90.

The single panel of reinforcing material 300 attaches the left side-seam 50 between an upper point 350 and a lower point 351. The lower point 351 is also the point at which the left side-seam intersects the left leg-shoulder-seam. The panel attaches to the left leg-shoulder-seam between the intersection of the leg-shoulder-seam and the left side-seam 351 and a second point 382.

The panel of reinforcing material 300 attaches the right side-seam 60 between an upper point 360 and a lower point 361. The lower point 361 is also the point at which the right side-seam intersects the right leg-shoulder-seam. The panel attaches to the right leg-shoulder-seam between the intersection of the leg-shoulder-seam and the right side-seam 361 and a second point 392.

The upper edge of the panel 330 and the lower edge of the panel 335 are both stitched to aid attachment to the trunk section. The reinforcement panel 300 as illustrated in FIG. 5 may allow compressive forces to be generated diagonally from left to right and from right to left. The panel may also generate compressive forces that act both transversely and longitudinally to the front of the wearer's pelvis. Thus, the single reinforcement panel may provide compressive forces to a wearer that influence the four muscle slings that contribute to pelvic stability; the anterior, posterior, longitudinal and lateral slings.

Further stitching may be used to assist the attachment of the reinforcement panel 300 to the front portion of the trunk section 22. Such stitching may, for example, traverse the panel 300 and extend between the side-seams 50, 60 and the leg-shoulder-seams 80, 90, or between the side-seams 50, 60 and the upper edge of the panel 330. Such stitching may increase the number of attachment points between the trunk section and the reinforcement panel 300, which may increase the effectiveness of the reinforcement. Such stitching may also be used for decorative purposes. For example, stitching may be provided across the single front reinforcement panel 300 such that it appears to be formed from two or more separate panels arranged in a crossing configuration.

The invention claimed is:

1. A compression garment fabricated from a resilient material, comprising:

a trunk section for conforming to a wearer's pelvic region, the trunk section having a front portion and a rear portion meeting at left and right side-seams;

a left leg section for conforming to at least an upper portion of the wearer's left leg, the left leg section joining the trunk section at a left leg-shoulder-seam;

a right leg section for conforming to at least an upper portion of the wearer's right leg, the right leg section joining the trunk section at a right leg-shoulder-seam;

at least one first front reinforcement panel extending diagonally across the front portion of the trunk section, attached to the garment at the left side-seam and the right leg-shoulder-seam, and generating a first force acting in a direction extending substantially diagonally-downward across the front portion between the left side-seam and the right leg-shoulder-seam;

at least one second front reinforcement panel extending diagonally across the front portion of the trunk section, attached to the garment at the right side-seam and the left leg-shoulder-seam, and generating a second force acting in a direction extending substantially diagonally-downward across the front portion between the right side-seam and left leg-shoulder-seam; and at least one third rear reinforcement panel extending substantially horizontally across the rear portion of the trunk section between the left side-seam and the right side-seam, attached to the garment at the left side seam and at the right side-seam, generating a third force acting in a direction extending substantially horizontally across the rear portion of the trunk section between the left side-seam and the right side-seam, and covering the wearer's left and right sacroiliac joints when worn, wherein the wearer's pelvic region is compressed by the third force when the garment is worn, wherein the first and second reinforcement panels comprise separate first and second front reinforcement panels or a single front reinforcement panel, wherein the trunk section is reinforced by the first, second, and third reinforcement panels such that when thr garment is worn the wearer's pelvic region is compressed by the first, second, and third reinforcing forces, respectively, and wherein the first and second reinforcing forces extend only between the respective side-seams and opposite leg-shoulder-seams, the third reinforcing force extends only between the side-seams, and no reinforcing force extends to either of the leg sections, such that the legs of the wearer are not restricted thereby.

2. A compression garment according to claim 1, wherein the at least one first front reinforcement panel and the at least one second front reinforcement panel comprise separate first and second front reinforcement panels.

3. A compression garment according to claim 2, wherein the first and second front reinforcement panels cross each other at a point covering the wearer's symphysis pubis joint.

4. A compression garment according to claim 1, wherein first and second forces act in directions extending diagonally-downwards at an angle of between 20 degrees and 35 degrees from a horizontal direction across the front of the garment.

5. A compression garment according to claim 2, wherein the first and second front reinforcement panels have a length dimension extending substantially diagonally between the respective side-seams and leg-shoulder-seams, and a width dimension substantially perpendicular to the length dimension, in which the width dimension is between 5 cm and 15 cm.

6. A compression garment according to claim 1, wherein the at least one first front reinforcement panel and the at least one second front reinforcement panel comprise a single front reinforcement panel.

7. A compression garment according to claim 6, wherein the attachment of the front reinforcement panel to the garment at the left side-seam is at an upper left portion of the front reinforcement panel, an upper right portion of the attachment of the front reinforcement panel to the garment at the right side-seam is at an upper right portion of the front reinforcement panel, the attachment of the front reinforcement panel to the garment at the left leg-shoulder-seam is at a lower left portion of the front reinforcement panel to the garment at the right leg-shoulder-seam is at a lower right portion of the first reinforcement panel.

8. A compression garment according to claim 6, wherein the single front reinforcement panel is substantially X-shaped.

9. A compression garment according to claim 6, wherein the single front reinforcement panel is narrower at a central portion covering a wearer's symphysis pubis than at either edge portion at which it attaches to the garment at the left and right side-seams.

10. A compression garment according to claim 1, wherein the width of the rear reinforcement panel or panels is between 5 cm and 15 cm where it joins to the left and right side-seams.

11. A compression garment according to claim 1, wherein the rear reinforcement panel has a greater width at a central point between the left and right side-seams than at the left and right side-seams.

12. A compression garment according to claim 1, wherein the trunk section has an upper edge defining an opening for encircling the wearer's torso, and one or more darts are formed in the upper edge to improve engagement of the garment with the wearer's torso.

13. A compression garment according to claim 1, wherein the left leg section defines a left leg opening for encircling the wearer's left leg above the wearer's left knee, and the right leg section defines a right leg opening for encircling the wearer's right leg above the wearer's right knee, in which the left and right openings are between 1 cm and 25 cm above the wearer's knees, the compression garment being a pair of compression shorts.

14. A compression garment according to claim 1, wherein the garment, when worn, provides a compressive force to the wearer's left and right sacroiliac joints and the wearer's symphysis pubis joint.

15. A compression garment according to claim 1, wherein there is no reinforcement panel extending onto the leg sections of the garment.

16. A compression garment according to claim 1, wherein reinforcement to the garment provides no substantial limitation to the wearer's active range of motion during hip flexion.

17. A compression garment according to claim 1, wherein the garment increases force closure of the wearer's symphysis pubis.

18. A compression garment according to claim 1, wherein, when the garment is worn, the compression force generated at the hips, as measured at the left or right side-seam, is between 15 and 28 mm Hg.

19. A compression garment fabricated from a resilient material, comprising:

a trunk section for conforming to a wearer's pelvic region, the trunk section having a front portion and a rear portion meeting at left and right side-seams;

a left leg section for conforming to at least an upper portion of the wearer's left leg, the left leg section joining the trunk section at a left leg-shoulder-seam;

a right leg section for conforming to at least an upper portion of the wearer's right leg, the right leg section joining the trunk section at a right leg-shoulder-seam;

at least one first front reinforcement panel extending diagonally across the front portion of the trunk section left to right from the left side-seam diagonally downward to the right leg-shoulder-seam adjacent the right side-seam, and generating a first force acting in a direction extending substantially diagonally-downward across the front portion between the left side-seam and the right leg-shoulder-seam; and at least one second front reinforcement extending diagonally across the front portion of the trunk section right to left from the right side-seam diagonally downward to the left leg-shoulder-seam adjacent the left side-seam, and generating a second force acting in a direction extending substantially diagonally-downward across the front portion between the right side-seam and the left leg-shoulder-seam;

wherein the first and second reinforcement panels comprise separate first and second front reinforcement panels or a single front reinforcement panel, wherein the trunk section is reinforced by the first and second front reinforcement panels such that, when the garment is worn, the first and second reinforcing forces apply compression to the wearer's sacroiliac joints and symphysis pubis, and wherein the first and second reinforcing forces extend only between the respective side-seams and leg-shoulder-seams and no reinforcement panel or force extends to either the of the leg sections such that the first and second reinforcing forces do not restrict the legs of the wearer and thereby the wearer maintains a full range of leg movement.

20. A compression garment according to claim 19, wherein a rear portion of the trunk section is reinforced by a panel or panels of a resilient material extending horizontally across a rear portion of the trunk section.

21. A method of using the compression garment according to claim 1, comprising using the garment for the treatment of lumbopelvic injury or disorder.

22. A method of using the compression garment according to claim 1, comprising using the garment as a prophylactic measure against lumbopelvic injury or disorder.

23. A method of using the compression garment according to claim 19, comprising using the garment for the treatment of lumbopelvic injury or disorder.

24. A method of using the compression garment according to claim 19, comprising using the garment as a prophylactic measure against lumbopelvic injury or disorder.

* * * * *